US007367865B2

(12) United States Patent
Blaum et al.

(10) Patent No.: US 7,367,865 B2
(45) Date of Patent: May 6, 2008

(54) METHODS FOR MAKING WAFERS WITH LOW-DEFECT SURFACES, WAFERS OBTAINED THEREBY AND ELECTRONIC COMPONENTS MADE FROM THE WAFERS

(75) Inventors: Peter Blaum, Weiterstadt (DE); Burkhard Speit, Mainz (DE); Ingo Koehler, Ingelheim (DE); Bernd Ruediger, Woerrstadt (DE); Wolfram Beier, Essenheim (DE)

(73) Assignee: Schott AG, Mainz (DE)

( * ) Notice: Subject to any disclaimer, the term of this patent is extended or adjusted under 35 U.S.C. 154(b) by 0 days.

(21) Appl. No.: 11/069,118

(22) Filed: Mar. 1, 2005

(65) Prior Publication Data

US 2005/0233679 A1 Oct. 20, 2005

(30) Foreign Application Priority Data

Mar. 3, 2004 (DE) ..... 10 2004 010 379

(51) Int. Cl.
*H01L 21/70* (2006.01)

(52) U.S. Cl. ..... 451/1; 438/478; 451/41

(58) Field of Classification Search ..... 438/478, 438/118, 690; 451/41, 42, 1
See application file for complete search history.

(56) References Cited

U.S. PATENT DOCUMENTS 6,418,921 B1 7/2002 Schmid et al.
6,596,080 B2 * 7/2003 Kawahara et al. ..... 117/106
6,932,679 B2 * 8/2005 Talieh et al. ..... 451/59
2002/0052064 A1 * 5/2002 Grabbe et al. ..... 438/113
2003/0096561 A1 * 5/2003 Talieh et al. ..... 451/36
2003/0127041 A1 * 7/2003 Xu et al. ..... 117/2
2004/0038544 A1 * 2/2004 Zhang et al. ..... 438/709

FOREIGN PATENT DOCUMENTS

DE 103 06 801 9/2004
EP 0 008 360 A1 3/1980

OTHER PUBLICATIONS

IBM, TDB, vol. 22, No. 4, 1979, p. 1453.

* cited by examiner

*Primary Examiner*—Jacob K. Ackun, Jr.
(74) *Attorney, Agent, or Firm*—Michael J. Striker

(57) ABSTRACT

The electronic semiconductor component has a crystalline wafer substrate with an active surface and a semiconductor layer coating the active surface. So that the semiconductor layer has a few surface defects the crystalline wafer substrate is a sapphire or silicon carbide single crystal and the active surface has a pit density of less than 500 pit/cm$^2$, preferably less than 100 pit/cm$^2$. The polishing method for obtaining the active surface with these pit densities includes polishing with a polishing agent, such as a silicon suspension, and a polishing tool, which is pressed on the active surface with a pressure of preferably from 0.05 to 0.2 kg/cm$^2$ and moved over the active surface with polishing motions distributed statistically and uniformly over a 360° angle during polishing.

15 Claims, 4 Drawing Sheets

AFM-Messungen,
50µm x 50µm

AFM-Messungen,
50µm x 50µm

AFM-Messungen,
50µm x 50µm

METHODS FOR MAKING WAFERS WITH LOW-DEFECT SURFACES, WAFERS OBTAINED THEREBY AND ELECTRONIC COMPONENTS MADE FROM THE WAFERS

BACKGROUND OF THE INVENTION

1. Field of the Invention

The present invention relates to low-stress substrate wafers with a low-defect, active surface, a method for making them and their uses. It also relates to electronic components, such as LEDs, transistors and chips made with them.

2. Related Art

Electronic and electro-optic semiconductor elements, such as lasers, high-speed transistors, LDs, LEDs and other complex components usually comprise a thin carrier or wafer substrate, especially on which functional layers are arranged over each other in a terrace-like manner. Functional layers of this sort are usually semiconductor or also insulating or balancing layers. To make this sort of component usually wafers are sawed off a block, cylinder and/or rod of a respective substrate and subsequently ground, lapped and polished, in order to obtain as planar and as smooth a surface as possible, which has a maximum elasticity and planarity and a minimum surface roughness. The grinding and polishing of the wafer is normally performed by a method in which the wafer substrate is fixed in a holder, which preferably rotates about its longitudinal axis and alternates its rotational direction, i.e. oscillates. The wafer substrate is pressed on a rotating grinding or polishing plate, which is equipped with a polishing pad, which similarly alternates its rotational direction. In this way the substrate surface to be coated is ground or eroded as smoothly as possible and smoothed so that a good to very good surface may be obtained. After that the functional layers are applied to the solid usually very thin substrate wafer.

One possibility for application of layers of this sort is the so-called epitaxy, especially metal-organic gas phase epitaxy (MOCVD=metal organic chemical vapor deposition or also MOCVPE=metal organic chemical vapor phase epitaxy). In this sort of method the semiconductor layers are deposited on each other on the heated substrate from reactive gaseous starting materials. The substrate and/or wafer are exposed to high temperatures, which lead to distortion and warping of the thin layers or platelets, so that non-uniform coatings are possible in the worst cases.

Moreover it has been shown that deposition of semiconductor layers on the wafer is a very temperature sensitive process and especially small temperature differences of 1° C. can lead to wavelength shifts of about 1 nm during manufacture of LEDs.

Furthermore it has been shown that defects in the surfaces themselves, faults in the crystal structure, impurities or even deviations of the surfaces from planarity can lead to defect sites in the layer structure, which impair the desired electrical insulating and/or electro-optic functions of the layer. A single observable defect of this sort, which suggests the existence of structural crystallographic defects, is called a "pit". Interference microscopy (e.g. by means of a Leica Interference microscope, 160-power (16×10) magnification, resolution max 0.8 μm) is a suitable method for detection of this type of defect.

SUMMARY OF THE INVENTION

It is an object of the present invention to provide a wafer substrate for making electronic and/or electro-optic semiconductor components, which are insensitive to temperature fluctuations by coating with epitaxy and from which semiconductor components that are at least low-defect in their semiconductor layers and especially have "pit"-free surfaces may be obtained.

This object is attained with the features defined by the appended claims.

According to the invention it has been shown that the formation of pits may be at least drastically reduced by means of a final polishing of the active substrate surface to be coated, and usually can even be completely prevented. The surface to be treated or polished is subjected to a polishing with changing polishing direction and indeed so that each site on the surface is essentially polished with polishing motions e.g. of a polishing tool distributed statistically and uniformly over a 360° angle. The polishing direction changes occur so that each surface position is polished statistically uniformly over all polishing directions.

The substrate to be coated is arranged freely movable between polishing elements in preferred embodiments. Wafer substrates, which are extremely insensitive to temperature changes, were obtained in this way. Furthermore the electronic components made from them were low in defects and even defect-free in some cases.

In the polishing method according to the invention the wafer substrates are preferably placed on a support (supporting table with a bearing surface) and pressed on the support with a counter element. Either support, counter element or both can be formed as a polishing tool. Preferably both are polishing tools. The substrate can slide freely between these elements (supporting element and counter element) in every direction relative to the polishing tool during polishing. These free motions include both two-dimensional linear and also curvilinear motions as well as rotations about an axis perpendicular to the wafer surface. The support preferably has a boundary or an edge, which bounds the supporting surface, on which the wafer substrate rests and on which the wafer can move freely without dropping off the support. The surface of the support is preferably as flat or planar as possible and especially is completely planar. In a preferred embodiment the support comprises a guide disk provided with at least one flat, hole-like receptacle, which has a larger diameter than that of the wafer to be worked. Usually, but not necessarily, the receptacle is formed by a through-going hole in the disk. It is also appropriate that this sort of guide disk is provided with several such receptacles or holes, which are obtained by means of punching and/or sawing. The wafer to be treated is placed in this receptacle or hole. The hole in the guide disk acts as a cage or carrier: within which the wafer or wafers are freely movable. In another preferred embodiment the guide disk is loose on the support, arranged freely movable, so that it can move and rotate in all spatial directions during the polishing and grinding process. The guide disk usual comprises metal and/or a plastic.

According to the invention it has now been found that especially planar wafer substrate surfaces were obtained by the procedure, but that also stresses in the wafer material, especially in the crystal lattice near the surface are eliminated, e.g. the stresses which arise by mechanical forces acting on the wafer during its preparation, especially during subdividing and grinding of the disk blanks and which are apparently not removable by tempering alone.

In a preferred embodiment the wafer in the form of a laminate is polished. In that case the wafer is glued or bound to a carrier. Preferably during polishing the carrier is freely movable, sliding on the support. The pressing force of the polishing tool acts in a more or less perpendicular direction on the wafer surface to be treated. However it is possible in principle that the wafer is arranged freely sliding on the carrier with its active surface to be polished and later to be coated directed downward. In an especially preferred embodiment an additional wafer is used as carrier, so that both the outer surface of one wafer (carrier wafer) adjacent to the support and the opposite outer surface of the other (second) wafer are polished. If the wafer laminates are freely movable in a so-called cage or "carrier", the continuous rotating motions act like the support. In this case the support and the counter element on it act like a polishing tool in the polishing apparatus.

The polishing is preferably performed with the help of a polishing agent or polishing medium. In principle all conventional polishing media can be used as long as they do not cause any scratching or other mechanical damage in the wafer surfaces and they produce sufficient surface smoothness or minimal surface roughness and a wafer surface which is planar or flat, which would be attained by subdividing, grinding and lapping the wafer, not destroyed again, but improved. The deep damage, also called sub-surface damage (SSD), induced by grinding and lapping steps, is worked out without producing troublesome new additional damage. Moreover the deep damage produced from prepolishing processing steps is eliminated and an optimal seed density for epitaxial coating is guaranteed. A suitable surface roughness usually is at most 0.3 nm and a suitable planarity usually is at maximum 10 μm, preferably up to 5 μm. However a planarity of at maximum 2 μm over the entire active wafer surface of the usual 2" to 4" wafer is especially preferred.

Preferably polishing agents containing polishing bodies are used in the method according to the invention. These polishing bodies preferably have an average particle size with a diameter of 10 to 1000 nm. However particles with diameters of 50 to 500 nm, especially 150 to 300 nm, are especially preferred. This sort of average diameter or particle size is determined in a known way optically by light scattering methods. For example the firm named Lambda Physics (Göttingen, DE), markets a light scattering apparatus for measuring particle size named Lambda 900 UV/Vis/IR with integrated ball lamp.

Preferred polishing agents include those used for treating silicon wafers, semiconductors, microchips, optical elements and watch crystals and glass components. The polishing according to the invention is performed abrasively by means of the respective grinding bodies, by which a desired layer thickness is eroded or worn away from the surface. Colloidal silicon oxide, which is obtained in the conventional industry standard as slurry, is a preferred grinding agent. This sort of product is for example obtained from the firm, Eminess Technologies, Inc., under the trade name Ultra sol (www.eminess.com/products/us slurry.html). It can also be obtained from the firm, Rodel, with the trademark NALCO® of NALCO company of Naperville, Ill., USA (www.rodel.com/rodel/products/substrates). These grinding agents are used in the form of a sol in an especially preferred embodiment of the method according to the invention. Particle sizes vary between 20 and 300 nm. The grinding agent should have a pH of 5 to 11, preferably 6.5 to 11 and especially preferably 8.5 to 10.5. Bicarbonate is a preferred buffer for adjusting the pH.

The polishing is usually performed under pressure. The polishing tool is pressed on the surface to be polished. This sort of pressure usually amounts to 0.05 to 1 kg/cm$^2$, especially 0.1 to 0.6 kg/cm$^2$, but 0.15 to 0.35 kg/cm$^2$ is especially preferred.

The polishing is usually performed with an, if necessary oscillating, rotation speed of 5 to 200 rpm, especially 10 to 80 rpm, however 20 to 50 rpm is especially preferred. Typical polishing times amount to up to 10 hours, but polishing times of up to 4, especially up to 2.5, hours are particularly preferred. Material abrasion or removal rates of 0.5 to 5 μm/h, especially 0.8 to 3 μm/h, and especially 1-2 μm/h are obtained. In this way it is possible to remove deep damage up to 6 μm, especially up to 5 μm, but removal rates up to 4 μm are especially preferred, without introducing noticeable stresses in the wafer, which can be detected for example by planarity measurements by means of a commercial interferometer. Surprisingly it has been shown that polishing agents, which are not otherwise recommended for a final polishing of the wafer surface, such as the polishing agent NALCO® 2354, can be used in the method according to the invention.

The polishing according to the invention is preferably performed at temperatures of below 100° C., preferably below 50° C., but temperatures under 25° C. are especially preferred. Polishing at room temperature of 20° C. is especially preferred. Variations in the temperature of ±8° C., especially ±5° C. and even better ±2° C. are possible. The temperature, at which the wafers are polished, is critical, as soon as the consistency of the grinding agent essentially changes and/or the viscosity increases, for example by agglomeration of grinding particles.

A wafer is releasably attached to a freely movable carrier, especially a polishing plate or other wafer, to make the substrate for polishing according to the invention. This usually happens by means of an adhesive. The adhesive layer thickness is preferably 0.5 to 5 μm, but 0.8 to 3 μm and especially 1 to 2 μm, is especially preferred. The adhesive is preferably softened by heating so that the wafer glued for polishing or wafer and carrier may be released again by increasing the temperature. The adhesive preferably has a softening temperature under 150° C., especially under 120° C., especially of less than 100° C. Softening temperatures under 80° C. are entirely especially preferred, but temperatures under 70° C. and especially under 50° C. are most preferred. In principle the adhesive selected for the method according to the invention should be such that it has a softening temperature, which is at least 10° C., preferably at least 20° C. below the temperature at which the surface is polished. A preferred adhesive agent has pressure, shear and/or elastic properties.

Wax and/or rosin are especially preferred for that purpose. The softening point of the adhesive mass is adjustable the mixture ratios. The more wax, preferably beeswax, which is contained in the adhesive mass, the less the softening point. In principle it is possible to use several waxes and of course as long as they have the above-described releasability upon heating. According to the invention useable waxes can be plant and animal and/or mineral waxes, if necessary mixtures of them. Suitable plant waxes include candelilla wax, cornauba wax, Japan wax, esparto grass wax, cork wax, guarana wax, rice seed oil wax, etc. Preferred animal waxes include beeswax, spermaceti wax, lanolin wax and buerzel fat wax. Suitable mineral waxes include ceresin wax, petrolatum wax, paraffin wax and microwax as well as fossil waxes. These waxes can be both natural and also chemically modified or completely synthetic. Beeswax, which has a melting point of 60 to 70° C. and/or 65 to 65° C. is especially preferred, as are similar waxes with a similar composition or similar properties. These similar waxes especially include wax esters, which especially contain 1-triacontanol as alcohol component, especially which is esterified with palmitic acid and/or heptacosanoic acid. Hydroxyfatty acids, such as hexacosyl-hydroxypalmitate and its usable derivatives, are preferred wax esters.

The adhesive to be used in the invention is preferably removable again from the wafer substrate. The removal can take place, for example, by melting by means of heating and/or also by the use of a suitable solvent, which will not damage the wafer or the properties of the wafer.

Crystalline wafer substrates are preferred, but crystalline $Al_2O_3$ (sapphire) and SiC crystals are especially preferred. $Al_2O_3$ crystals are usual obtained with known crystal growing methods, such as the Czochralski technique. However it has been shown that the method according to the invention is independent of it's the manner of making the crystal and the preceding treatment steps in all cases and leads to the desired good results. It is possible to make wafer substrates with the method according to the invention, which are usable to make electronic and/or electro-optic components with semiconductor layer systems, which have an extremely small number of defects. Especially these components have a pit density of less than 1000/cm$^2$, particularly less than 500/cm$^2$, but less than 100/cm$^2$ is particular preferred. In many cases it is also possible to make components with pit densities of less than 60/cm$^2$, particularly less than 50/cm$^2$ and preferably less than 30/cm$^2$ and especially preferably less than 20/cm$^2$. In most cases it is also possible to produce components with pit densities less than 10/cm$^2$ and especially with low numbers of defects, i.e. less than 1-2/cm$^2$.

An especially preferred polishing method according to the invention comprises chemical-mechanical polishing techniques (CMP techniques). Silicon colloids, which are hydrolyzed to finely dispersed colloids in an alcohol/water solution of methyl silicates and 100 to 200 ppm ammonium salts according to sol-gel methods, are preferred. A typical solution contains 25% colloids of this sort, in which the particle sizes are between 550 nm, especially 250 nm. Bacterial formation can be prevented, for example by adding hydrogen peroxide. However it should be considered that an agglomeration, especially by dehydration or condensation of the silicon colloids should be avoided, which can lead to formation of scratches on the substrate surfaces. During use of the CMP methods on aluminum oxide the $SiO_2$ reacts with $Al_2O_3$ to form $Al_2Si_2O_7$, which is softer than the sapphire ($Al_2O_3$). It is easily removed by mechanical pressure during polishing.

The invention also concerns the substrate wafer obtained by the method according to the invention and its uses to make electronic components used in lasers and high intensity light emitted diodes for high temperature and high power electronic applications. The invention further concerns the use of this type of wafer for making solar cells.

Finally the invention concerns electronic semiconductor components, which comprise one or more low-defect layers made of semiconductor materials arranged one above the other on a substrate and which are obtained by means of the method according to the invention. This especially includes the making of a single crystal and if necessary tempering of the single crystal, subdividing the single crystal to form wafer substrate disks, grinding and/or lapping and polishing the disks including the final polishing according to the invention and cleaning at least one of the disk surfaces.

BRIEF DESCRIPTION OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
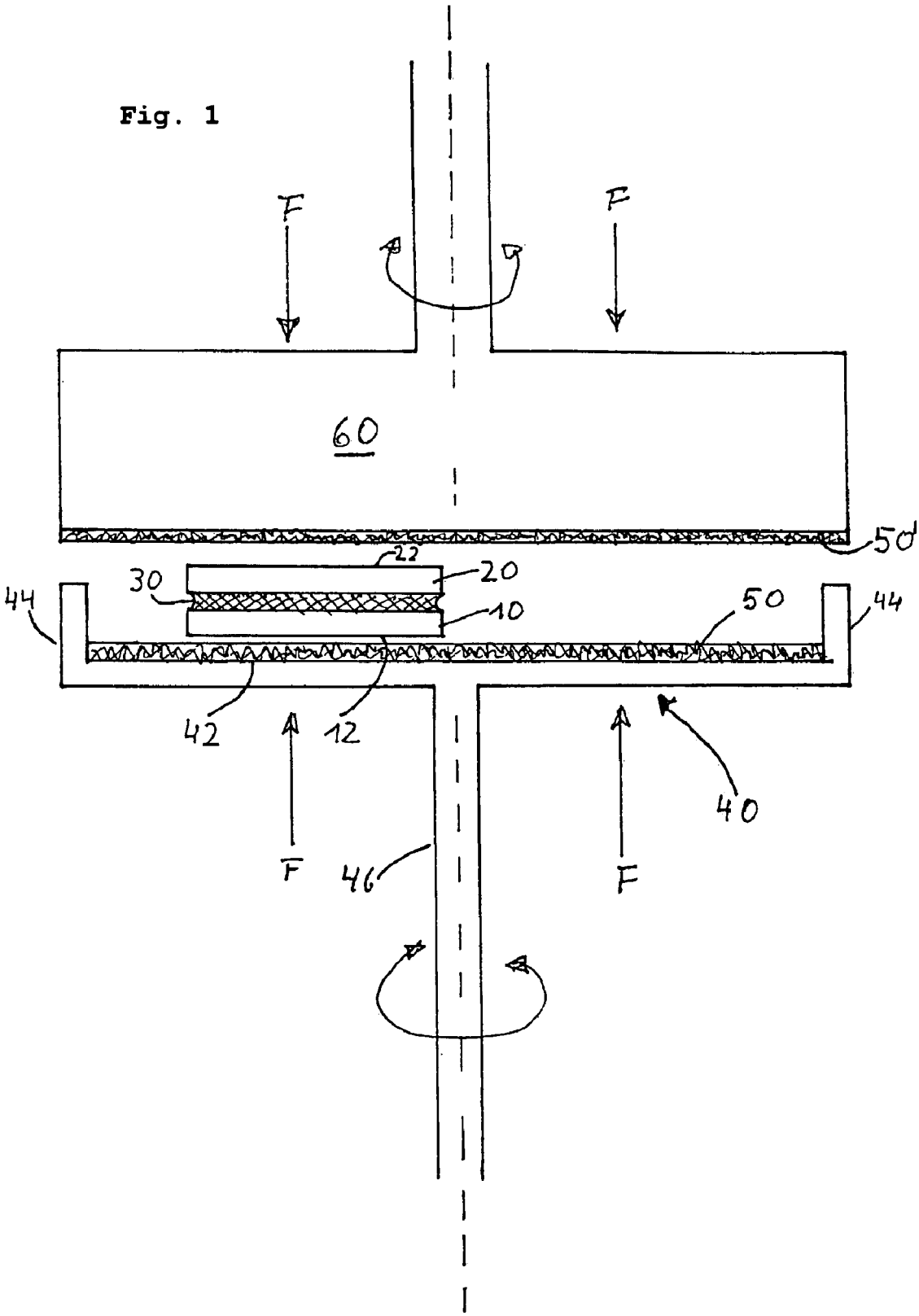
FIG. 1 is a schematic cross-sectional view of an apparatus for performing the polishing according to the invention.

The procedure according to the invention is shown in FIG. 1. A wafer is bonded to a carrier 20 by an adhesive 30. The laminate 10, 20, 30, which results, has outer surfaces 12, 22 and interior surfaces bonded by the adhesive. It rests on a polishing plate or dish 40 rotating about the axis 46. The polishing plate is provided with wall 44 on its outer edge, which prevents the laminate and/or the guide disks from dropping off. This occurs by fixing and guiding the wafer on the polishing plate and is preferably achieved by plastic disks, the so-called cage or "carrier" (not shown). The polishing plate 40 contains a polishing agent 50 on its inner surface 42, which contains fine particles. The polishing plate can perform an eccentric rotation if necessary. However rotational motions with alternating rotation direction, i.e. oscillating rotations, about axis 46 are preferred. A pressing plate 60, which has a grinding agent 50' on its lower side 62, acts on the wafer laminate from above. The pressing plate 60 rotates or oscillates about a longitudinal axis 66. The polishing agent is preferably applied on a cloth or fabric (not shown). Polishing fabrics of this sort preferably comprise, e.g., commercial polyurethane fabric. The laminate structure 10, 20, 30 is preferably freely movable within the boundary wall 44 between the pressing and/or polishing disk 60 and the polishing plate 40. The CMP process is preferably performed as a multi-step process, in which the grain size is reduced. A typical grain size reduction of 100 to 10 nm occurs, but a reduction of 600 to 40 nm, especially 500 to 50 nm, is particularly preferred. In the polishing process according to the invention the grain size is typically reduced in at least two stages, preferably three stages.

The positive effects, among others, of the polishing process according to the invention and/or the results after LED or HEMT coating are shown in FIGS. 2*a*, 2*b* and 3*a*, 3*b*, 3*c*.

Figure 2A:
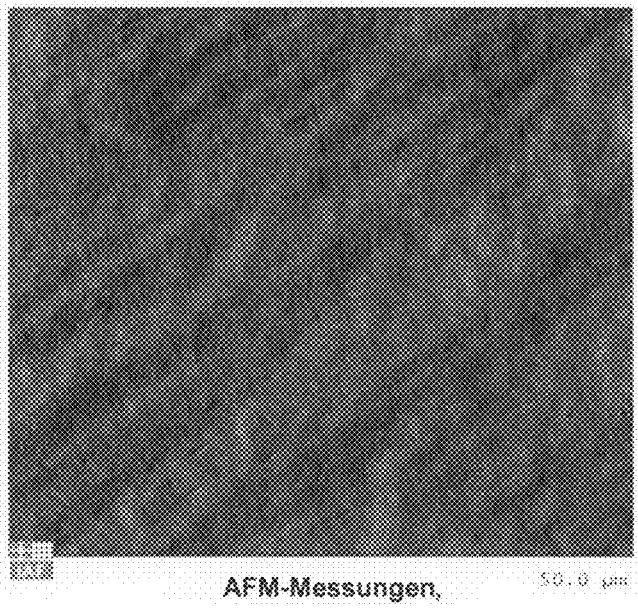
FIG. 2*a* is an AFM-measured view of a surface of a MOCVD coated LED, which was made from a substrate prepared with the method according to the invention.
Figure 2B:
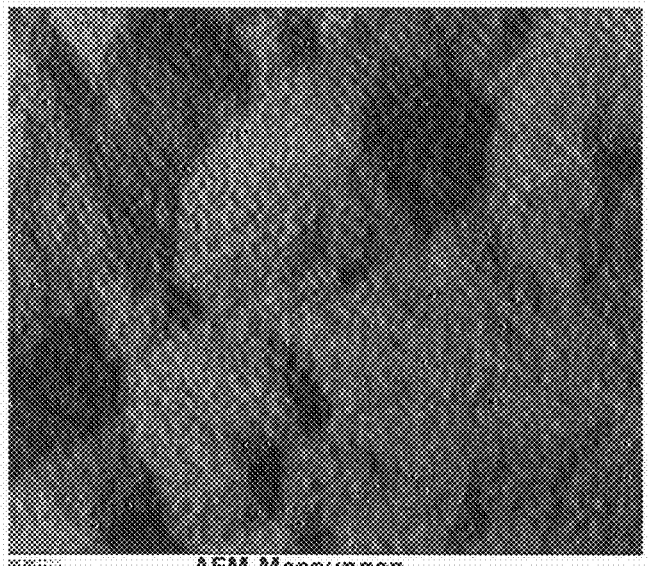
FIG. 2*b* is an AFM-measured view of a surface of a MOCVD coated LED, which was made from a commercially obtained substrate prepared with prior art methods, for comparison with FIG. 2*a;*

FIG. 2*a* shows the magnified surface of a LED (light emitting diode) structure on a wafer surface according to the invention (see Table II). FIG. 2*b* shows a magnified surface of a similar LED on a commercially obtained comparative wafer surface of the prior art (comparison wafer Nr. 3), as described in Table II.

Figure 3A:
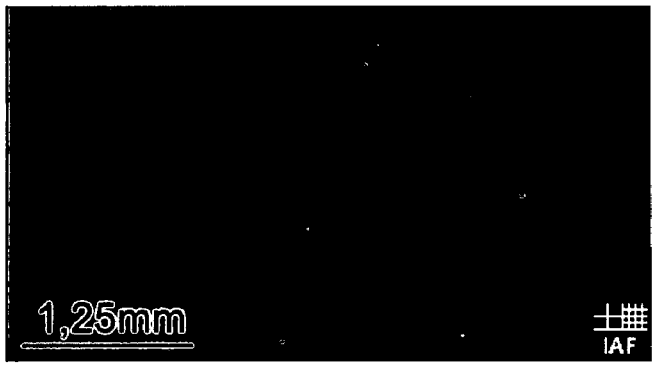
FIG. 3*a* is a magnified view of a surface of a HEMT (High electron mobility transistor) functional layer on a substrate made with the method according to the invention.
Figure 3B:
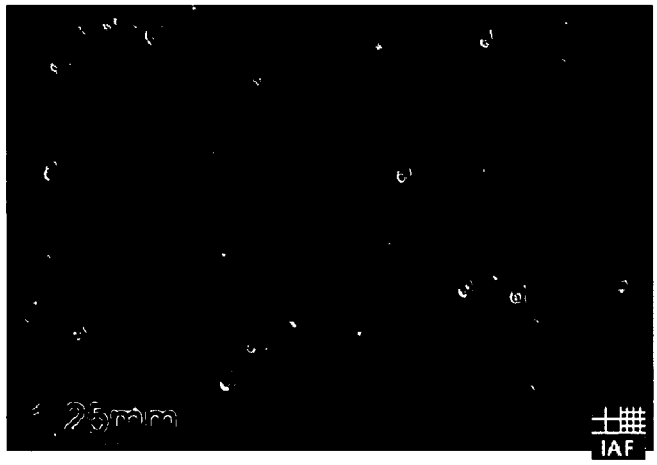
FIGS. 3*b* and 3*c* are respective magnified views of surfaces of HEMT (High electron mobility transistor) functional layers on prior art substrates, for comparison with FIG. 3*a;*
Figure 3C:
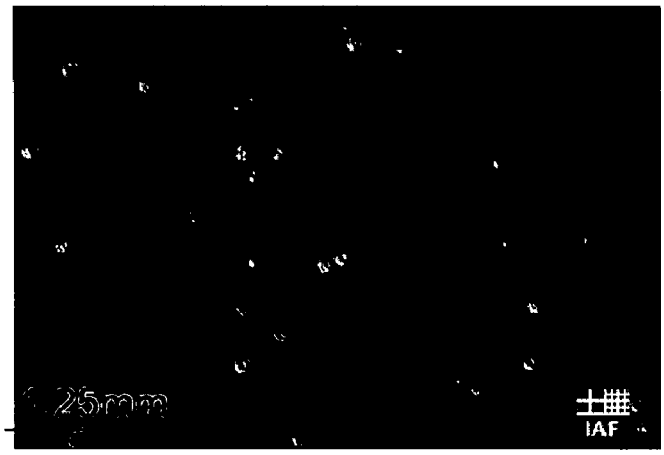

FIGS. 3*a*, 3*b*, 3*c* are high magnification interference microscope photographs of HEMT (High electron mobility transistor) structures, which are grown by an epitaxy method on a sapphire substrate processed by the method according to the invention (FIG. 3*a*) and on commercially obtained comparative substrates (FIGS. 3*b* and 3*c*) grown at temperatures of 50 K above the optimum process temperature reported by the manufacturer.

Figure 4A:
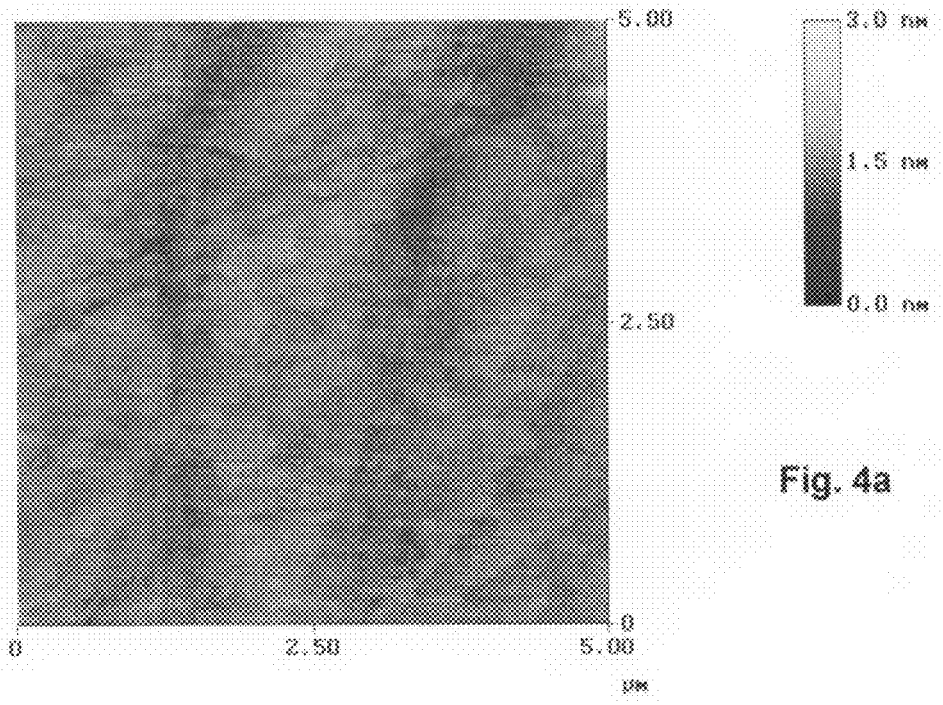
FIG. 4*a* is a magnified view of a surface of a commercial sapphire substrate after performing the standard polishing process according to the prior art, which shows the surface quality and/or roughness.
Figure 4B:
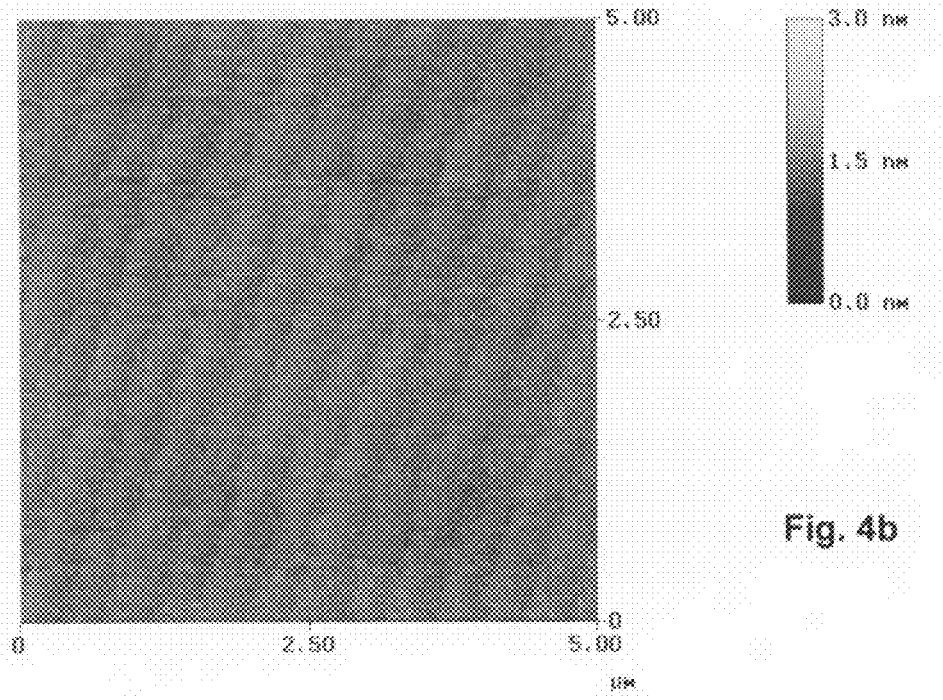
FIG. 4*b* is a magnified view of a surface of a wafer after performing the polishing process according to the invention, for comparison to FIG. 4*a*.

FIG. 4*a* shows the respect surface quality of a commercial sapphire substrate after performing a standard polishing process, as it is available commercially, and FIG. 4*b* shows the same wafer after polishing according to the invention.

The polished sapphire substrate according to the invention has the uniform symmetrical surface structure especially preferred for epitaxial coating. The surface polished according to the invention not only has an essentially smaller surface roughness of 0.2 nm, but also a substantially better or greater planarity of 5 μm over its entire diameter of 2" to 4". In contrast a comparison with the state of the art (commercially obtained substrate) shows that the surface roughness of the prior art substrate is about 0.3 nm and the planarity is about 7 to 8 μm for a 2" wafer or up to 10 μm for a 4" wafer over its entire diameter.

EXAMPLES

The following examples serve to illustrate the invention, but their details should not be construed as limiting the appended claims.

A sapphire crystals with a diameter of 55 mm and a length of 200 mm was grown by the Czochralski method and subsequently tempered, as described in the unpublished German Patent Application DE-A 103 06 801.5 of the applicants responsible for the present invention. Subsequently the single crystal so obtained was sawed into thin disks with a thickness of 0.5 mm and ground and lapped according to the method described in F. Schmid, et al, U.S. Pat. No. 6,418,921 B1. After that the wafer was subjected to a polishing process according to the invention, as described in the following example.

Two wafer substrates were glued together with an adhesive material between facing sides of the wafer substrates to form a laminate. A rosin-beeswax mixture with a softening point of 80° C. was used in a thickness of about 2 μm as the adhesive material.

This laminate was subsequently pre-polished chemically-mechanically for 1.5 hours in a silicon suspension with grain size of 250 to 300 nm and after that polished chemically-mechanically with the colloidal silicon suspension with varying polishing times in another polishing machine. Both processes occurred with processing pressures of 0.1 to 0.3 kg/cm$^3$ and rotational speeds of the polishing plate of 50 to 150 rpm. Wafer substrates were glued together to form laminates with different mixture ratios and different softening temperatures. The adhesive was adjusted so that its softening temperature was such that a force of not more than 1 Kp (per 5 cm wafer [corresponding to 20 cm$^2$]) would be required for separation of the wafers.

Commercial CMP lotions, like those marketed by Cabot Microelectronics Corporation under the trademark NALCO® with product classifications 2350, 2371 and SS-25, were used as chemical-mechanical polishing agents. The polishing times for both processes amount to up to four hours. Deep damage up to 2 μm deep was removed by means of removal rates of 0.2 to 2.5 μm, without observing introduction of stresses which lead to deformation, which was tested by means of a commercial interferometer.

The actual removal was followed by means of a commercial white light interferometer (WLJ) of the firm Spectra Physics until the second polishing process was finished after removal of at least 2 μm. The substrates obtained by means of the method according to the invention were characterized with respect to their pit densities after MOCVD coating with LED layers.

The results are presented in the following Table I.

TABLE I

PIT DENSITIES FOR WAFER SUBSTRATES MADE BY THE METHOD ACCORDING TO THE INVENTION

| Adhesive Softening temperature, ° C. | Polishing pressure, kg/cm$^2$ | Polishing time, h, For removal of 2 μm | Pit Densities, #/cm$^2$ in center |
|---|---|---|---|
| 60 | 0.1 | 2.5 | 250 |
| 80 | 0.2 | 1 | 15 |
| 100 | 0.25 | 0.75 | 750 |
| 120 | 0.3 | 0.5 | 3500 |
| 120 | 0.25 | 0.75 | 3000 |
| 50 | 0.1 | 2.5 | 215 |

Subsequently wafers processed according to the present invention were compared with commercially obtained wafers. The defect densities of these coated sapphire substrates are reported in Table II and illustrated in FIGS. 2*a* and 2*b*.

TABLE II

COMPARISON OF PIT DENSITIES FOR WAFER SUBSTRATES MADE ACCORDING TO THE INVENTION AND PRIOR ART WAFER SUBSTRATES

| Manufacturing Method | Pits/cm$^2$ in Center |
|---|---|
| Comparison Wafer 1 (commercially obtained) | 2300 |
| Comparison Wafer 2 (commercially obtained) | 1800 |
| Comparison Wafer 3 (commercially obtained) | 2000 |
| Wafer of the invention | 0 |

In additional experiments or tests the wafer substrates obtained by the method according to the invention were coated with HEMT functional layers by means of a commercial process under equal conditions in a multi-wafer MOCVD apparatus. However during the coating process the processing temperature was varied. The results are shown in Table II. The results show that the processing temperature of wafers, which were treated according to the method of the invention, could vary in a certain range, i.e. up to 50° C., without generation of growth errors. With the wafers of the prior art small changes already lead to large numbers of growth defects as reported in Table III and illustrated with the help of FIGS. 3*a* to 3*c*. This surprising difference is the result of the polishing method according to the invention. If the wafers obtained commercially according to the prior art are subjected to a polishing process according to the invention, they have uniform symmetric surface properties according to the invention (see FIGS. 4*a* to 4*b*) and are similarly largely insensitive to processing temperature fluctuations like the wafer substrates tempered and grown for this special application.

TABLE III

GROWTH DEFECTS FOR WAFERS MADE BY THE METHOD ACCORDING TO THE INVENTION AND THE PRIOR ART AS A FUNCTION OF PROCESSING TEMPERATURE VARIATION

| PROCESSING TEMPERATURE VARIATION, K | Growth Defects/cm$^2$, Invention | Growth Defects/cm$^2$, Prior Art #1 | Growth Defects/cm$^2$, Prior Art #2 | Growth Defects/cm$^2$, Prior Art #3 |
|---|---|---|---|---|
| 50 | 0 | 300 | 330 | 303 |
| 30 | 0 | 200 | 220 | 230 |
| 20 | 0 | 100 | 107 | 104 |
| 10 | 0 | 50 | 20 | 50 |
| 0 | 0 | 0 | 0 | 0 |

The disclosure in German Patent Application 10 2004 010 379.8-33 of Mar. 3, 2004 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a methods for making wafers with low-defect surfaces, wafers obtained thereby and electronic components made from the wafers, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A crystalline wafer substrate for an electronic semiconductor element, wherein said crystalline wafer substrate consists of a single crystal, said single crystal consists of sapphire or silicon carbide, said single crystal has at least one active surface, said at least one active surface has a pit density of less than 500 pits/cm$^2$, and said crystalline wafer substrate having said at least one active surface with said pit density less than 500 pits/cm$^2$ is obtained by a method comprising the steps of:

a) polishing by a polishing means said at least one active surface of said crystalline wafer substrate in order to smooth said at least one active surface; and b) during the polishing changing a polishing direction of a polishing tool performing the polishing over said at least one active surface so that each site or location on the at least one active surface is polished with polishing motions of the polishing tool distributed statistically and uniformly over a 360° angle.

2. The crystalline wafer substrate as defined in claim 1, wherein said pit density is less than 100 pits/cm$^2$.

3. The crystalline wafer substrate as defined in claim 1, wherein said pit density is less than 10 pits/cm$^2$.

4. The crystalline wafer substrate as defined in claim 1, wherein said pit density is measured by interference microscopy at 160 power magnification with a maximum resolution of 0.8 microns.

5. The crystalline wafer substrate as defined in claim 1, wherein said polishing tool is pressed against said at least one active surface during said polishing with a polishing pressure of 0.1 to 0.6 kg/cm$^2$.

6. The crystalline wafer substrate as defined in claim 1, wherein the polishing comprises chemical-mechanical polishing with a silicon suspension acting as polishing agent.

7. The crystalline wafer substrate as defined in claim 1, wherein the crystalline wafer substrate is attached to a freely movable carrier by an adhesive material during the polishing, the adhesive material has a thickness of 1 to 2 μm, and the carrier is another wafer substrate bonded with said crystalline wafer substrate by said adhesive material and said another wafer substrate is also polished during the polishing.

8. An electronic semiconductor component comprising at least one light emitting diode, said electronic semiconductor component consisting of a single crystalline wafer substrate with at least one active surface and one or more LED layers coating said at least one active surface;

wherein said single crystalline wafer substrate is a sapphire single crystal or a silicon carbide single crystal and said at least one active surface has a pit density of less than 500 pit/cm$^2$, and wherein said single crystalline wafer substrate with said at least one active surface with said pit density of less than 500 pit/cm$^2$ is obtained by a method comprising the steps of:

a) polishing by a polishing means said at least one active surface of said wafer substrate in order to smooth said at least one active surface; and b) during the polishing changing a polishing direction of a polishing tool performing the polishing over said at least one active surface so that each site or location on the at least one active surface is polished with polishing motions of the polishing tool distributed statistically and uniformly over a 360° angle.

9. The electronic semiconductor component as defined in claim 8, wherein said pit density is less than 10 pits/cm$^2$ and said pit density is measured by interference microscopy at 160 power magnification with a maximum resolution of 0.8 microns.

10. The electronic semiconductor component as defined in claim 8, wherein the polishing comprises chemical-mechanical polishing with a silicon suspension acting as polishing agent and during the polishing said polishing tool is pressed against said at least one active surface with a polishing pressure of 0.1 to 0.6 kg/cm$^2$.

11. The electronic semiconductor component as defined in claim 8, wherein the crystalline wafer substrate is attached to a freely movable carrier by an adhesive material during the polishing, the adhesive material has a thickness of 1 to 2 μm, and the carrier is another wafer substrate bonded with said crystalline wafer substrate by said adhesive material and said another wafer substrate is also polished during the polishing.

12. An electronic semiconductor component for laser applications comprising at least one light emitting diode, said electronic semiconductor component consisting of a single crystalline wafer substrate with at least one active surface and one or more LED layers coating said at least one active surface;

wherein said single crystalline wafer substrate is a sapphire single crystal or a silicon carbide single crystal and said at least one active surface has a pit density of less than 100 pit/cm$^2$, and wherein said single crystalline wafer substrate with said at least one active surface with said pit density of less than 100 pit/cm$^2$ is obtained by a method comprising the steps of:

a) polishing by a polishing means said at least one active surface of said wafer substrate in order to smooth said at least one active surface; and b) during the polishing changing a polishing direction of a polishing tool performing the polishing over said at least one active surface so that each site or location on the at least one active surface is polished with polishing motions of the polishing tool distributed statistically and uniformly over a 360° angle.

13. The electronic semiconductor component as defined in claim 12, wherein said pit density is less than 2 pits/cm$^2$ and said pit density is measured by interference microscopy at 160 power magnification with a maximum resolution of 0.8 microns.

14. The electronic semiconductor component as defined in claim 12, wherein the polishing comprises chemical-mechanical polishing with a silicon suspension acting as polishing agent and during the polishing said polishing tool is pressed against said at least one active surface with a polishing pressure of 0.05 to 0.1 kg/cm$^2$.

15. The electronic semiconductor component as defined in claim 14, wherein the crystalline wafer substrate is attached to a freely movable carrier by an adhesive material during the polishing, the adhesive material has a thickness of 1 to 2 μm, and the carrier is another wafer substrate bonded with said crystalline wafer substrate by said adhesive material and said another wafer substrate is also polished during the polishing.

* * * * *